United States Patent [19]

Ikeda

[11] Patent Number: 5,002,332

[45] Date of Patent: Mar. 26, 1991

[54] CABIN CONSTRUCTION OF WHEEL LOADER

[75] Inventor: Kenji Ikeda, Osaka, Japan

[73] Assignee: Kubota Ltd., Osaka, Japan

[21] Appl. No.: 405,346

[22] Filed: Sep. 11, 1989

[30] Foreign Application Priority Data

Sep. 16, 1988 [JP] Japan ..... 63-233134

[51] Int. Cl.[5] ..... B60J 1/00

[52] U.S. Cl. ..... 296/190; 49/502

[58] Field of Search ..... 296/190, 148, 146; 180/89.12, 89.19, 326; 49/502

[56] References Cited

U.S. PATENT DOCUMENTS

| | | | |
|---|---|---|---|
| 3,847,492 | 11/1974 | Kennicutt et al. | 296/190 |
| 3,866,969 | 2/1975 | Sandrock et al. | 296/190 |
| 4,184,712 | 1/1980 | Skahill | 296/190 |
| 4,518,195 | 5/1985 | Tintall et al. | 296/148 |

FOREIGN PATENT DOCUMENTS 63-65763 10/1988 Japan .

*Primary Examiner*—Robert R. Song

*Attorney, Agent, or Firm*—Gifford, Groh, Sprinkle, Patmore and Anderson

[57] ABSTRACT

A cabin construction of a wheel loader having a vehicle body with a driver's section at a rear position, a backhoe detachably attached to a rear end of the vehicle body and a cabin for covering the driver's section. The improvement includes a detachable rear end cabin door construction which permits an easy and economical exchange of the rear door as necessary for the varying uses of the vehicle. A first door is used when the vehicle body is attached with the backhoe whereas a second door is used when the vehicle body is used without the backhoe. The feature has eliminated the necessity of costly and troublesome replacement of the entire cabin construction and is advantageous also for forming a compact the rear end of the vehicle.

8 Claims, 5 Drawing Sheets

CABIN CONSTRUCTION OF WHEEL LOADER

BACKGROUND OF THE INVENTION

1. Field of the Invention

The present invention relates to a cabin construction of a wheel loader having a vehicle body with a driver's section at a rear position, a backhoe detachably attached to a rear end of the vehicle body and a cabin for covering the driver's section.

2. Description of the Related Arts

In a known wheel loader of the above-noted type, the cabin is constructed integrally, i.e. undetachably with the driver's section so as to cover the top and four lateral sides of the same. With this integral construction, there arises an inconvenience if the vehicle is to selectively cope with two different modes of use, where the vehicle is used with connection with the backhoe and where the vehicle is used without the backhoe connection, since the former mode requires an additional space for accommodating a control unit for the backhoe which, when installed, projects within the cabin. In order to accommodate with these different cases, there must be provided several cabins of different constructions.

More particularly, when it is necessary to equip the vehicle with the backhoe. A cabin having an undetachable flat rear wall cannot accommodate the backhoe control unit, whereby the entire cabin must be replaced by another cabin having a rearwardly projecting rear wall. Needless to say, such replacement of entire cabin is troublesome and costly.

The present invention attends to this drawback of the prior art.

SUMMARY OF THE INVENTION

In order to overcome the above-described drawback, in a cabin construction of a wheel loader of the above type, the cabin according to the present invention comprises: a cabin body for covering a top, front and right and left sides of a driver's section and having a rear opening; and first and second rear doors selectively and detachably attached to a rear side of the cabin body; the first rear door being used when a backhoe is connected with the vehicle body whereas the second rear door being used when the backhoe is not connected with the vehicle body.

Functions and effects of the above characterizing construction will be described next.

With the detachable and exchangeable rear doors, the entire cabin body does not need to be replaced in order to accommodate the two different modes, i.e. having the backhoe-connected and without the backhoe connected. All that is needed is the replacement of the rear door which is much lighter and thus easier to handle than the entire cabin body. Therefore, this feature significantly reduces the trouble of replacement and also the costs of the cabin construction.

Further, according to one preferred embodiment, the first rear door when attached to the cabin body has a rearward extention for accommodating a control unit and a pair of foot rests within the cabin when the backhoe is attached to the wheel loader.

With this further feature of the invention, the control unit and the foot rests attached to the backhoe may be accommodated within the cabin at the additional space formed by the rearward extension of the first rear door without significantly limiting the free foot space or lower space for the driver. Therefore, the driver seated at his rearward-directed seat position can comfortably carry out a backhoe operation. Conversely, when the backhoe is not necessary, the second rear door having a substantially flat face is attached. In this case, the cabin may be formed compact without unnecessary rearward extension.

In most of the conventional wheel loader vehicles, at his forward-directed seat position for operating the front loader, the driver uses as the foot rests the front portions of the wheel fenders or portions of the vehicle frame positioned at approximately same height.

Then, according to a further embodiment of the invention, the wheel loader includes an engine hood for covering the top of an engine, the hood being formed concave at a rear top portion thereof, a wheel fender portion exposed by the concave rear top portion and foot rests of a backhoe device together constituting foot step means.

With this additional feature of the invention, there occurs no variation in the height of the foot rests for the seated driver between the backhoe-connected condition where he is seated with the rearward orientation and the backhoe-unconnected condition where he is seated with the forward orientation. Further, the driver can easily switch over and set his seat position simply by rearwardly pivoting the seat located on the engine hood. Moreover, since the portions of the wheel fender are used as the foot rests in this construction, the rear end of the cabin can be formed compact, hence, the entire vehicle can be formed still more compact in its longitudinal dimension.

In the above construction, if the base portion of the portal frame is disposed outwards in the vehicle transverse direction relative to the wheel fender portions, this wheel loader obtains a ROPS (Roll-Over Protection Structure) feature.

Further and other objects, features and effects of the invention will become apparent from the following more detailed description of the embodiments of the invention with reference to the accompanying drawings.

BRIEF DESCRIPTION OF THE DRAWINGS

Accompanying drawings illustrate one preferred embodiment of the present invention relating to a cabin construction of a wheel loader; in which.

DESCRIPTION OF THE PREFERRED EMBODIMENT

One preferred embodiment of the invention will be particularly described hereinafter with reference to the accompanying drawings.

Figure 1:
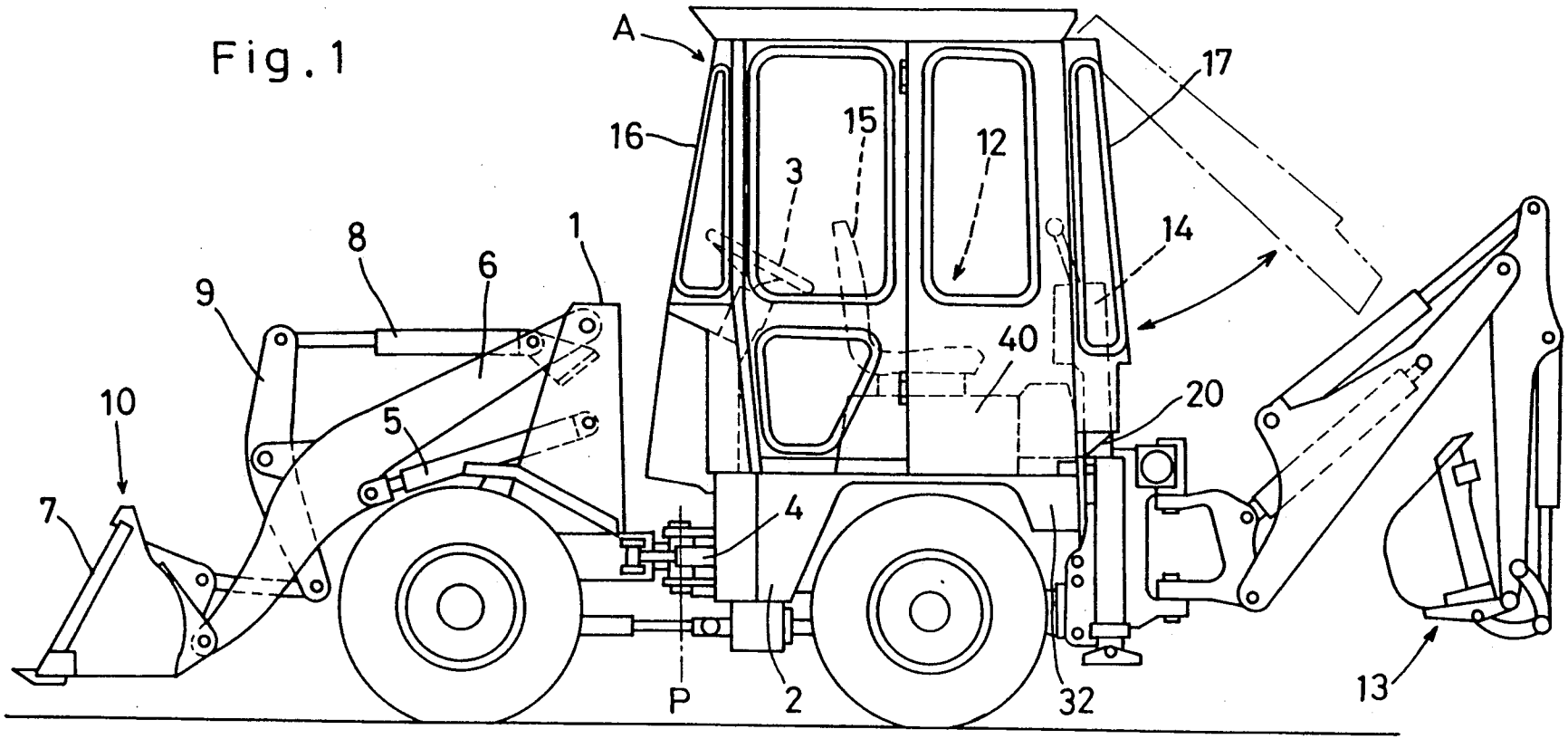
FIG. 1 is an overall side view of the loader mounted with a backhoe.

FIG. 1 shows a wheel loader equipped with a cabin A to which the present invention relates. This wheel loader includes a front body 1 and a rear body 2 interconnected with each other while being pivotable about a vertical axis P, such that the travelling loader can make a turn by operating a steering wheel 3 mounted on the rear body 2 for expanding or contracting a hydraulic cylinder 4 thereby to pivot the front body 1 relative to the rear body 2. The front body 1 carries at a forward position thereof a front loader device 10 including a lift arm 6 vertically pivotable by a lift hydraulic cylinder 5, an excavating bucket 7 pivotably connected to a leading end of the lift arm 6, a pivot arm 9 for pivoting the bucket 7 via a pivot hydraulic cylinder 8. On the other hand, the rear body 2 mounts therein an unillustrated engine and also mounts thereon a driver's section 12 covered with the cabin A.

Figure 3:
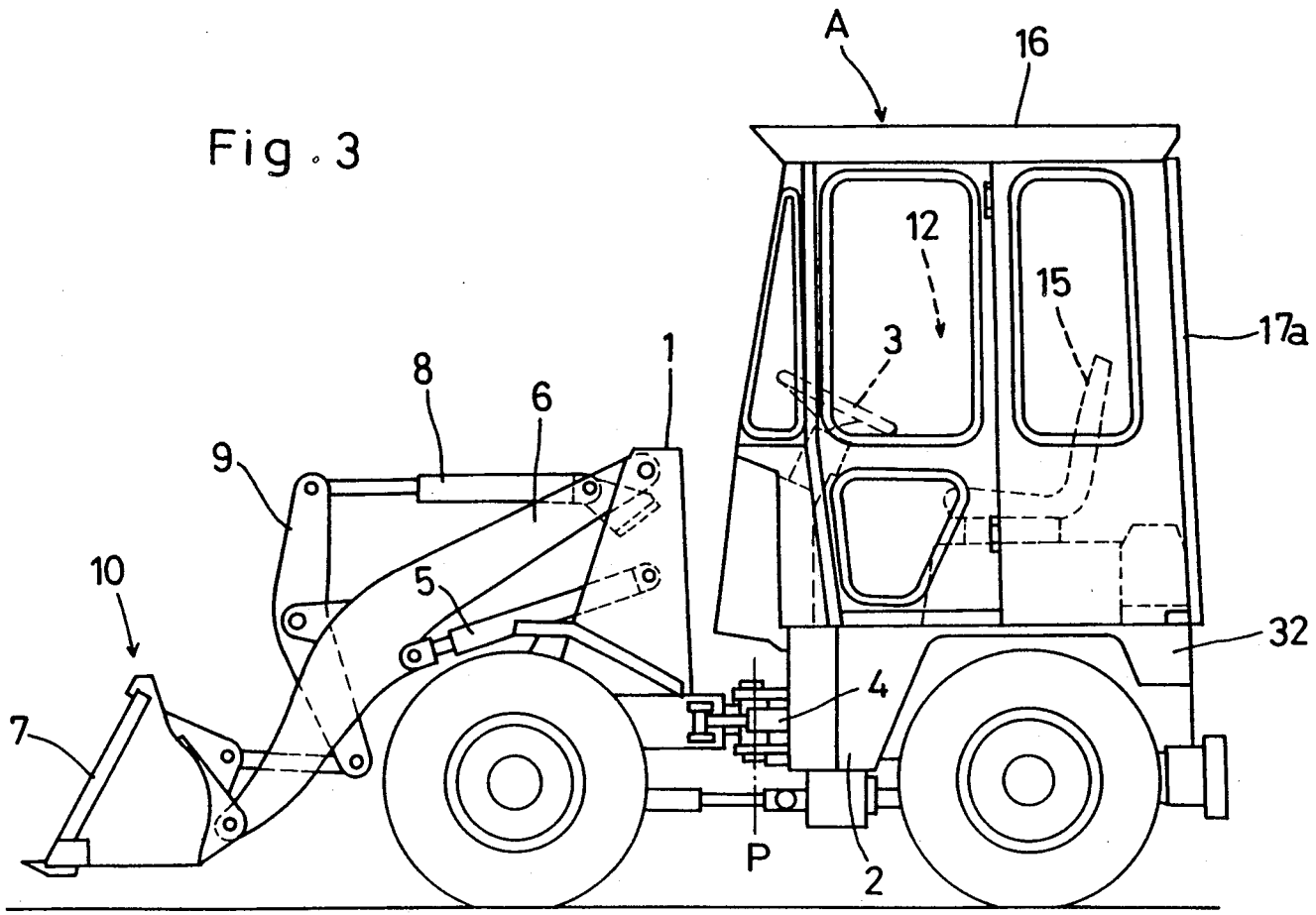
FIG. 3 is an overall side view of the loader with the backhoe being detached therefrom.

Incidentally, in this wheel loader, the rear body 2 permits, at a rear end thereof, a detachable attachment of a backhoe device 13. FIG. 1 shows this backhoe device 13 being attached to the rear body 2, whereas, FIG. 3 shows the backhoe 13 being detached from the same where only the front loader device 10 is to be used. This backhoe device 13 includes a control unit 14 extending from a pivotal base of the device 13 upwardly and forwardly relative to the loader body and a pair of foot rests 20. These foot rests 20 are bolt-connected to opposed sides of the control unit 14 and are configurated with a rearward upslope as illustrated.

In connection with the above-described backhoe arrangement, a driver's seat 15 of the driver's section 12 is pivotable about a vertical axis selectively and lockably into a front-facing position for steering the wheel loader and for operating the front loader device 10 and a rear-facing position for operating the backhoe device 13.

Figure 2:
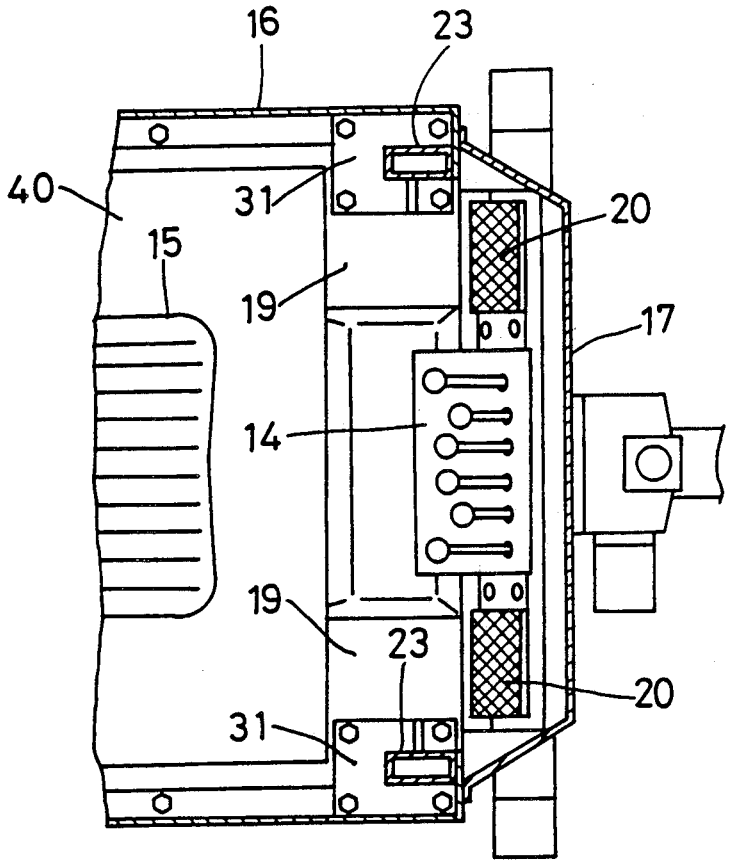
FIG. 2 is a plane view of major portions inside the cabin.

Further, as illustrated in FIGS. 1 and 2, an engine hood 40, which covers the top of the engine, is formed concave at its rear top portion so as to provide sufficient lower area and foot clearance for the driver seated at the seat 15 locked in the rear-facing position, such that the driver may maintain his vertical seating position substantially constant regardless of the seat (i.e. front-facing or rear-facing) position. The bottom face of the engine hood 40 is comprised of portions 19 forming the wheel fenders. These wheel fender portions 19 and the foot rests 20 of the backhoe 13 together are used as foot rest means for the driver seated at the rearwardly oriented driver's seat 15.

Next, a construction of the cabin A will be particularly described.

Figure 4:
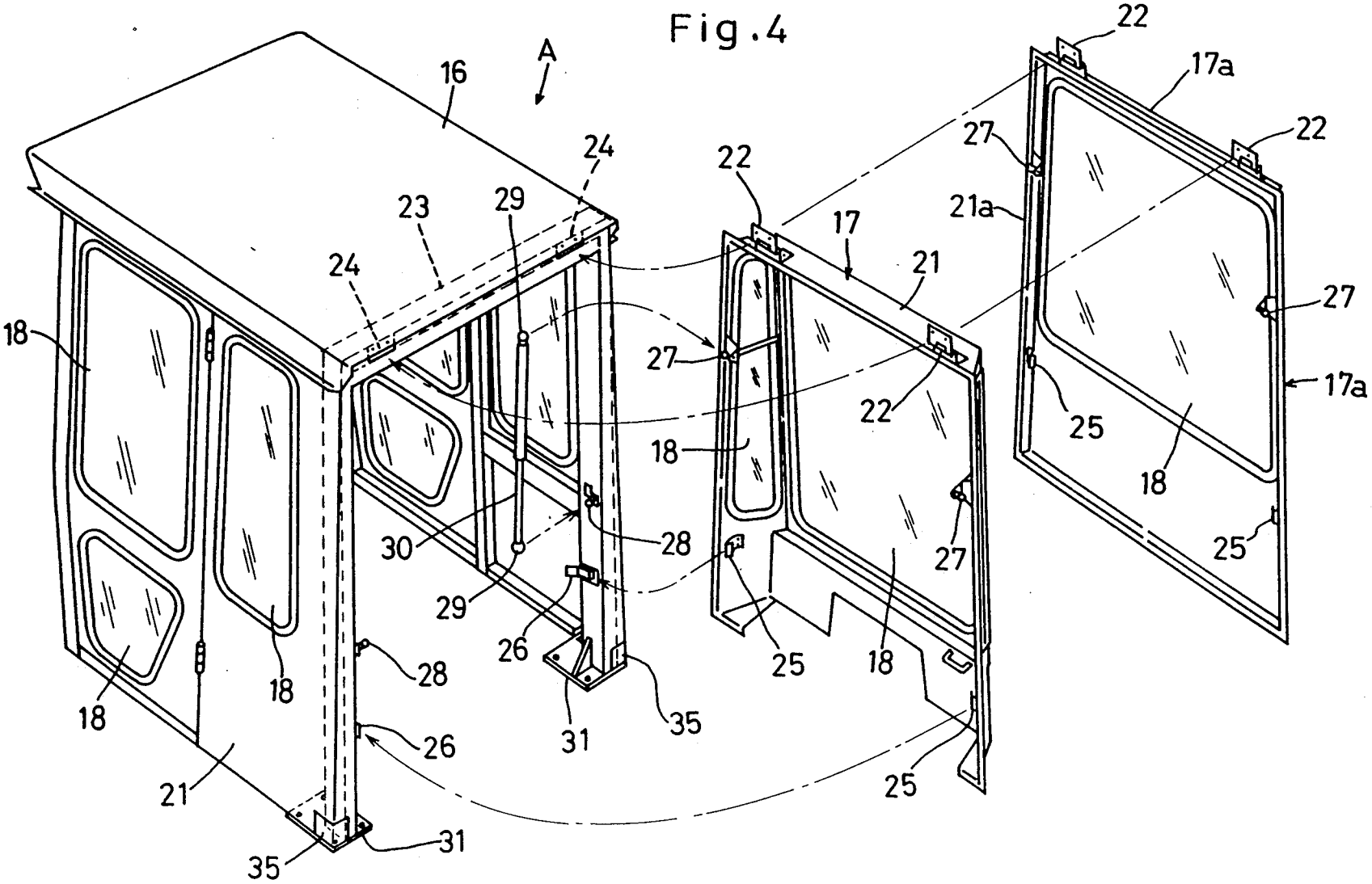
FIG. 4 is a exploded perspective view of the cabin.

Referring to FIG. 4, this cabin A includes a cabin body 16 for covering a top and front and right and left sides of the driver's section 12 and having a rear opening and first and second rear doors 17 and **17*a* selectively and detachably attached to a rear side of the cabin body 16 so as to close the rear opening of the same. Much of the front and right and left sides of the cabin body 16 is formed of transparent glass plates 18 so as to provide the driver with a high driving and working visibility in these directions. First, FIG. 2 illustrates one case where the first rear door 17 is attached to the cabin body 16. As shown, this first rear door 17 has a rearward projection for accommodating the control unit 14 and the pair of foot rests 20 of the backhoe device 13 within the cabin A when attached to the same. Similar to the cabin body 16, the first rear door 17 is formed mostly of transparent glass plates 18 except for its metal frame structure 21 (FIG. 4), such that a good visibility is provided to the driver when he is seated rearwards also. Further, as shown in FIG. 4, this first rear door 17 is detachably attached, via a right and left positioned pair of hinges 22 and 22 fixed to its upper edge, to the upper rear end of the cabin body 16, with the door 17 being pivotable about a horizontal axis so as to open or close the rear opening of the cabin body 16. The hinges 22 are disconnectably bolt-connected with a corresponding pair of attaching seats 24 fixedly secured to a portal frame structure 23 incorporated at the rear end position of the cabin body 16. Also, a pair of stopper elements 25 fixed to opposite inner and lower side faces of the door 17 come into snap-in engagement with a corresponding pair of buckle type locking elements 26 fixed to corresponding lower side opposed positions on the cabin body 16, whereby the first rear door 17 may be locked at the closed position relative to the cabin body 16 and also may be released and pivoted into an opened position by releasing the snap-in engagement between the stopper elements 25 and the locking elements 26**.

For manually effecting the above door movements, there is provided a door opening/closing mechanism including a pair of stays 27 fixedly secured to the metal frame structure 21, which structure acts as an outer peripheral frame at opposite upper side portions of the first rear door 17, a further pair of stays 28 fixedly secured to upper and lower center positions of the opposed sides of the portal frame structure 23 of the cabin body 16 and a corresponding pair of air suspension cylinders 30 with ball joints 29, such that the first rear door 17 is urged towards its opening direction by the cylinders 30 and may be locked at its closed position.

Further, as shown in FIG. 2, the base portion of this portal frame structure 23 is disposed outwards in the vehicle transverse direction relative to the wheel fender portions 19. This arrangement serves to strengthen the ROPS feature.

Conversely, when the driver uses only the front loader device 10 and the backhoe device 13 is not necessary, the backhoe device 13 is detached from the rear body 2 as illustrated in FIG. 3, and the first rear door 17 is also detached from the cabin body 16. Thereafter, the second rear door **17*a*, which has a flat shape, is attached to the cabin body 16 in substantially the same manner as the attachment of the first rear door 17. That is, this second rear door 17*a* is also detachably attached to the cabin body 16 by bolt-connecting a right and left positioned pair of hinges 22 fixed to its upper edge to the attaching seats 24 of the cabin body 16, with the door 17*a* being pivotable about the horizontal axis so as to open or close the rear opening of the cabin body 16. Also, the second rear door 17*a* is lockable at its closed position and releasable therefrom by means of the buckle type locking elements 26**.

With the above-described construction, the same cabin body 16 may be used for both of the backhoe-connected mode and the backhoe-unconnected mode. That is, for the change of the operational condition, the replacement between the first rear door 17 and the second rear door **17*a*** alone is necessary, whereby the replacement operation may be significantly facilitated and the costs of the entire cabin may be reduced.

Figure 5:
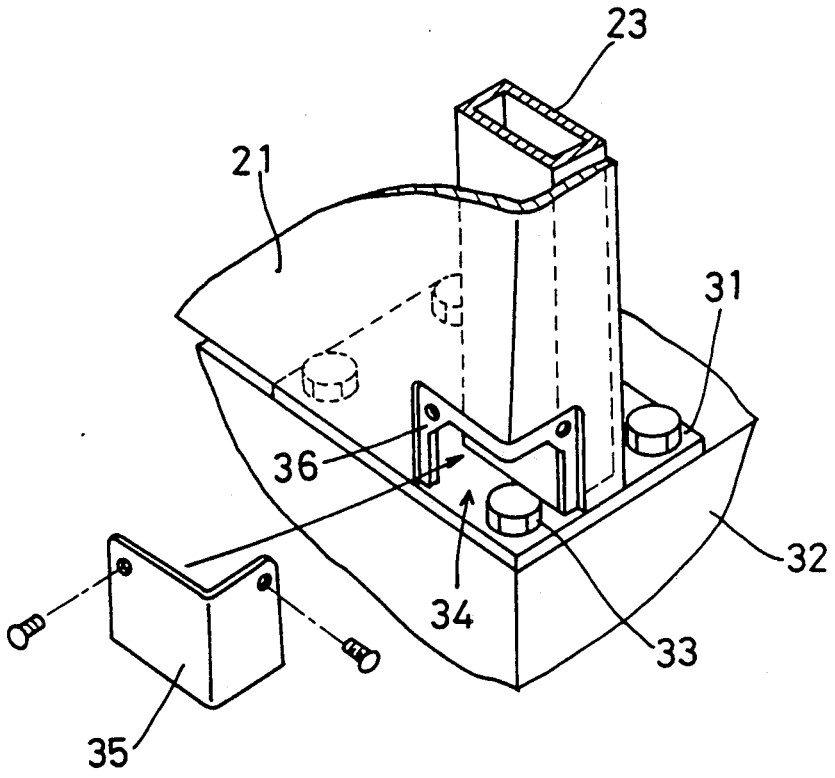
FIG. 5 is a perspective view showing an attaching position for a portal frame.

FIG. 5 shows an attaching portion where a lower end of the portal frame structure 23 is attached to the rear body 2. This lower end of the portal frame structure 23 fixedly carries an attaching plate 31 for a bolt-connection with the rear body 2, such that four corner portions of the attaching plate 31 are connected with a rear body frame 32 by means of bolts, respectively. In this construction, there is provided an arrangement which facilitates the connections of the bolts 33 which is difficult from the inner side of the cabin A. This arrangement permits the bolt connection from the outer side of the cabin A which is much easier than that from the inner side of the same. More particularly, the metal frame structure 21 of the cabin body 16 defines a cutout 34 at each corner thereof, through which cutout 34 the connecting bolt 33 is connected. After this bolt connection is completed, the cutout 34 is closed by a cover member 35. That is, at an inner peripheral edge face of the cutout 35, there is fixedly attached a connecting element 36 for the cover connection, such that after the attachment of the cover element 35 an outer surface of this cover element 35 may be disposed flush with an outer suface of the metal frame structure 21 of the cabin body 16.

What is claimed is:

1. A cabin construction of a wheel loader having a vehicle body with a driver's section at a rear position, a backhoe detachably attached to a rear end of the vehicle body and a cabin for covering the driver's section, said cabin construction comprising:

a cabin body for covering a top and front and right and left sides of a driver's section and having a rear opening; and first and second rear doors selectively and detachably attached to a rear side of the cabin body for closing said rear opening of the cabin body;

said first rear door being used when a backhoe is connected with the vehicle body whereas said second rear door being used when the backhoe is not connected with the vehicle body.

2. A cabin construction as defined in claim 1, wherein said first rear door has a rearward projection for accommodating a control unit and a pair of foot rests as part of the backhoe within the cabin when said first rear door is attached to the cabin body.

3. A cabin construction as defined in claim 1, wherein said second rear door is formed as a flat plate.

4. A cabin construction as defined in claim 1, wherein said cabin body incorporates a portal frame structure perpendicularly attached to a rear end of a rear body frame, said portal frame structure defining the configuration of said rear opening.

5. A cabin construction as defined in claim 4, wherein said first and second rear doors are pivotably attached to an upper edge of said portal frame to be openable and closable and are urged in the opening direction by air suspension cylinder means.

6. A cabin construction as defined in claim 4, wherein said wheel loader includes an engine hood for covering the top of an engine, said hood being formed concave at a rear top portion thereof, a wheel fender portion exposed by said concave rear top portion and foot rests of a backhoe device together consitituting foot step means.

7. A cabin construction as defined in claim 6, wherein said foot rests are formed with a rear upslope.

8. A cabin construction as defined in claim 6, wherein a base of said portal frame is disposed outwards in the vehicle transverse direction relative to said wheel fender portions.

* * * * *